US005586681A

United States Patent [19]

Policappelli

[11] Patent Number: 5,586,681

[45] Date of Patent: Dec. 24, 1996

[54] CONTAINER FOR DISPENSING LIQUIDS

[76] Inventor: Nini E. Policappelli, 361 N. Robertson Blvd., Los Angeles, Calif. 90048

[21] Appl. No.: 378,461

[22] Filed: Jan. 26, 1995

Related U.S. Application Data

[63] Continuation-in-part of Ser. No. 29,791, Mar. 11, 1993, abandoned.

[51] Int. Cl.[6] ..... B65D 25/28

[52] U.S. Cl. ..... 220/674; 220/710; 220/755; 220/906; 206/459.5; 215/382

[58] Field of Search ..... 220/6, 265, 266, 220/267, 270, 666, 667, 669, 670, 671, 672, 673, 674, 675, 705, 709, 710, 906, 907, 755, 771; 215/382, 383, 384, 900; 229/103.1; 222/80, 81, 82, 83, 92, 211, 464, 541; 206/459.5

[56] References Cited

U.S. PATENT DOCUMENTS

| | | | |
|---|---|---|---|
| D. 246,229 | 11/1977 | Saunders | 220/906 |
| D. 250,933 | 1/1979 | Saunders | 220/906 |
| 343,133 | 6/1886 | Leighton, Jr. et al. | 215/382 |
| D. 356,501 | 3/1995 | Kerwick et al. | D9/518 |
| 397,163 | 2/1889 | Zinsser, Jr. | 220/408 |
| 1,073,897 | 9/1913 | Goss . | |
| 2,139,143 | 12/1938 | Wiswell | 221/47.3 |
| 2,563,352 | 8/1951 | Morse | 229/14 |
| 2,617,590 | 11/1952 | van der Spek | 222/83 |
| 2,715,089 | 4/1953 | Michener et al. | 154/125 |
| 2,932,437 | 4/1960 | Wilcox | 220/755 |
| 3,083,877 | 4/1963 | Gash | 222/107 |
| 3,194,468 | 7/1965 | Baron | 229/1.5 |
| 3,236,697 | 2/1966 | Amiet et al. | 136/162 |
| 3,335,902 | 8/1967 | Javorik | 220/72 |
| 3,356,209 | 12/1967 | Pezely, Jr. | 206/46 |
| 3,385,501 | 5/1968 | Chang | 229/7 |
| 3,397,820 | 8/1968 | Smith | 222/83 |
| 3,474,844 | 10/1969 | Lindstrom et al. | 150/0.5 |
| 3,547,299 | 12/1970 | Kepple | 220/4 |
| 3,547,308 | 12/1970 | Gilliem | 220/90.2 |
| 3,557,788 | 1/1971 | Swartz | 128/232 |
| 3,825,151 | 7/1974 | Arnaud | 220/906 |
| 3,940,001 | 2/1976 | Haefner et al. | 215/1 C |
| 4,050,605 | 9/1977 | Wakana et al. | 220/5 |
| 4,155,474 | 5/1979 | Bizzarri | 215/384 |
| 4,228,913 | 10/1980 | Mack et al. | 220/90.2 |
| 4,324,340 | 4/1982 | Belokin | 220/1 |
| 4,325,490 | 4/1982 | Conrad | 220/269 |
| 4,356,927 | 11/1982 | Cooper et al. | 220/90.2 |
| 4,403,709 | 9/1983 | Meins et al. | 220/90.4 |

(List continued on next page.)

FOREIGN PATENT DOCUMENTS

| | | | |
|---|---|---|---|
| 661255 | 7/1929 | France | 215/382 |
| 668757 | 10/1964 | Italy | 215/382 |
| 2266290 | 10/1993 | United Kingdom | 220/669 |

OTHER PUBLICATIONS

Joseph B. Cahill, "Firm builds Coke a can with curves", Aug. 7, 1995; Crain's Chicago Buisness, V 18, n 32, p. 4.

*The Canner*, "Diacut," Mar. 1995, p. 35.

*Primary Examiner*—Stephen J. Castellano

*Attorney, Agent, or Firm*—Merchant, Gould, Smith, Edell, Welter & Schmidt

[57] ABSTRACT

A container is provided with grip enhancing protrusions of various shapes and sizes, which are raised and integrally formed on the container, thereby increasing the volume. The protrusions are arranged such that a person grasping the container will predominantly contact the protrusions rather than the body of the container, thereby reducing transfer or conduction of heat between the user's hands and the container. The ornamentation on the surface provides a layer of lettering on the surface which extends over the protrusions to enhance the ornamentation. A partially collapsible container adapted to contain beverages or other dispensable fluids includes a collapsible portion for the automatic deployment of either a drinking straw or a pour spout mounted within the container. In its non-collapsed state, the straw or spout is hidden within the container and is strutted between the top and bottom of the container to support the container during shipping and handling.

10 Claims, 6 Drawing Sheets

U.S. PATENT DOCUMENTS

| | | | |
|---|---|---|---|
| 4,415,097 | 11/1983 | Meins | 220/90.4 |
| 4,572,412 | 2/1986 | Brach et al. | 215/900 |
| 4,609,113 | 9/1986 | Seki | 215/1 |
| 4,645,078 | 2/1987 | Reyner | 215/383 |
| 4,709,829 | 12/1987 | Johnson et al. | 220/90.2 |
| 4,775,564 | 10/1988 | Shriver et al. | 428/35 |
| 4,877,148 | 10/1989 | Larson et al. | 220/90.2 |
| 4,941,573 | 7/1990 | Fuerstman | 206/459.5 |
| 5,002,199 | 3/1991 | Frahm | 220/670 |
| 5,070,801 | 12/1991 | Frederick | 220/403 |
| 5,148,930 | 9/1992 | Ota et al. | 215/1 |
| 5,158,190 | 10/1992 | Sosenko | 215/384 |
| 5,174,469 | 12/1992 | Policapelli | 220/710 |
| 5,203,490 | 4/1993 | Roe | 229/1.5 B |
| 5,299,700 | 5/1994 | Beniacar | 215/12.1 |

CONTAINER FOR DISPENSING LIQUIDS

RELATED APPLICATION

This application is a continuation-in-part of U.S. Ser. No. 08/029,791, filed Mar. 11, 1993, now abandoned. The contents of that application are incorporated by reference herein.

BACKGROUND

This invention relates to a container for fluids which are easily dispensed. In particular, this invention relates to providing an enhanced can for beverages, the can being physically relatively stronger, relatively larger than a standard size can, relatively enhanced for temperature conduction and relatively more attractive.

The invention also relates to a container having a partially collapsible portion which, upon manual manipulation, reveals a drinking straw, funnel, or pour spout mounted within the container in order to conveniently dispense the fluids contained therein.

Traditional beverage containers typically have smooth cylindrical surfaces, the container being of a size that can easily be grasped by a user. However, because containers of beverages are often immersed in ice coolers, or naturally accumulate condensation, which renders the outer surface slippery to handle, containers can become difficult to hold. Moreover, in an attempt to keep the container of a size that can easily be held by a normal user, the beverage container is often relatively tall, to ensure that the proper amount of volume is maintained. The additional height of each beverage container can, cumulatively, cause storage problems as each beverage container takes up additional vertical space. Thus, there is a need for a beverage container having a surface that offers a better grip to the user, while permitting the height of the beverage container to be relatively shorter, to make more efficient use of storage space.

There is also a need to have a container which has inherent insulating characteristics, so as to provide thermal insulation between the user and the container. Because many containers of the aluminum variety conduct heat freely, it would be advantageous to have a beverage container which actually decreases conduction.

It would be advantageous to provide a beverage container having unique visual effects which would distinguish the product over others.

For many consumers, it is preferable to consume beverages from a container by means of a drinking straw. The use of a straw is generally considered a more sanitary form of beverage consumption. Furthermore, a straw is convenient and easy to use, and is usually a neater and cleaner method for drinking. That is, the fluid being consumed is less likely to be spilled if a straw is used because the container generally does not have to be tipped. Accordingly, it is desirable for a large segment of the population to drink with a straw.

There have been several attempts to mount a drinking straw inside of a container in a spring-loaded fashion. According to these attempts, when the container is open, the straw pops up for use by the consumer. However, such previous attempts have proven to be unreliable in that the straw did not actually pup-up as intended. Therefore, manufacturers of containers who wish to provide a drinking straw with each container usually mount the straw somewhere on the exterior of the container. While this allows the use a straw, it is inconvenient to remove the straw from the exterior of the container and to insert it into the container. Additional packaging for the straw to keep it clean and some means for adhering the straw to the container. These problems increase manufacturing costs and the possibility of litter and debris.

SUMMARY

The present invention solves the problems presented by the prior art.

According to the invention the exterior of the container is provided with various protrusions integral with the container, which provide additional grip so that the container can be better held when wet or cold. The protrusions are stamped outward and are integrally formed on the container such that the volume within the container is increased by the protrusions. The protrusions can be of any shape, and any texture, and can be randomly interspersed throughout the perimeter of the container, or organized in a pattern. The effect of these protrusions is to increase the volume of the container and to provide proper gripping means.

The increase in volume provided by the protrusions also facilitates the manufacture of containers of a shorter height, if it is desired to retain the same volume for the standard container. Because the protrusions provide the proper gripping means, and also increase the volume of the container, the container can be made shorter. The containers can also be made wider without affecting the user's ability to grasp the container properly as the protrusions actually enhance the grippability of the container. By making the containers slightly shorter than a standard shape container, the containers can be more efficiently stored and/or displayed, especially in refrigerator display units having limited height.

In addition, the protrusions are situated around the perimeter of the container such that less heat is conducted between the user's hand and the container. Because the user's hand comes into contact primarily with the protrusions, which have limited surface area, less surface area contact between the user's hand and the container is provided. Not only does this help prevent the cold liquid in the container from being heated by conduction from the user's warm hands, but also helps prevent the cold temperature of the liquid in the container from being transferred by direct conduction to the user's hand, providing more comfort to the user.

In addition, these protrusions can be made in any shape or texture, including shapes identifying the product with the consuming public, including logos, trademarks, trade names and lettering. The protrusions are preferably a shape selected to be at least one of repetitive triangle, star, rectangle, circle or recognizable form. The body of the container includes an outside surface which includes a layer which can be a printing of an ornamental representation on the outside surface. The ornamental representation extends at least in part over the protrusions thereby to enhance the ornamental effect of the surface by providing a three-dimensional or embossing effect of the ornamentation on the surface.

Moreover, the protrusions can be configured to provide additional rigidity and strength to the container, which would otherwise not be possible with a smooth, cylindrical surface.

Preferably, there is also provided a partially collapsible container having a drinking straw, funnel, or pour spout incorporated within the container. When the container is collapsed in its intended fashion, the straw or spout is exposed for easy consumer use. Thus, rather than mechanically activating the straw within the can, the present invention simply and mechanically allows the user to activate the container, while the straw remains essentially stationary. This is a much more reliable form of straw deployment and results in high consumer satisfaction.

According to one embodiment of the present invention, the upper portion of the fluid container is collapsible, preferably due to its construction at this location which is corrugated or accordion-like. The corrugation of the surface of the container at this location allows it to be manually collapsed by the consumer.

Before use, the container is normally shaped, with most of the surface of the container being non-corrugated. This construction, including the collapsible portion, is rigid, thus allowing the container to be packaged with other similar containers and shipped and handled in the normal course of its distribution and sale without being prematurely collapsed. In this embodiment, the container is also supported in the vertical direction by a structurally supporting straw positioned vertically within the container. The straw, however, can be shifted from its supporting position when collapsibility is desired.

In this embodiment, the drinking straw is mounted within the container and is arranged so that it extends between the top of the container and the bottom of the container. The straw is mounted at the bottom within the container by means of a pivoting tab which restricts vertical movement but allows some pivoting movement. When not in use, the straw remains vertically abutted between the top and bottom of the container due to its precise fit within the container.

The top of the container is provided with a structurally weakened segment which eventually serves as an opening for the container. The weakened nature of the segment is provided, for example, by perforations or scoring of the container surface. The straw is positioned, however, so that its upper end does not align with the opening but rather within the space between the opening and the edge of the container.

Upon use, the consumer presses the side of the container near the straw immediately below the opening. This forces the straw within the can to be shifted loose from its vertical position and into a position whereby the top of the straw is immediately adjacent and below the opening. A U-shaped raised guide on the bottom inside portion of the top of the container keeps the straw centered directly below the opening.

Following this step, the collapsible portion of the container is manually manipulated by the consumer to cause that portion to collapse. Some extra manual effort is required to overcome the initial structural rigidity of the container even at the corrugated location. Thereafter, however, the corrugations in the container permit that portion to be readily collapsed. As the container is collapsed, the weakened segment in the top of the container comes into contact with the upper portion of the drinking straw. Since the straw is rigidly mounted in the vertical direction at its lower end within the container and is constructed from a sufficiently rigid material, the upper portion of the straw penetrates the weakened portion on the top of the container and causes it to fail, automatically opening the container. The upper portion of the straw thereby becomes exposed on the exterior of the container and is ready to use by the consumer.

The drinking end of the straw may also be adapted to extend further out from the can for easier access by the consumer. The straw may, for example, be constructed with an accordion-like section which is initially compressed within the container. The straw also has a rigid tubular member mounted within the straw at the junction of the accordion-like material to stiffen the straw and keep it from bending as the straw is laterally shifted to its position underneath the opening upon exposing the upper portion of the straw through the container opening, it is then pulled and the accordion-like section expanded to effectively increase the length of the straw.

In another embodiment of the present invention, a funnel or pour spout which is also rigidly mounted within the container and arranged so as to be adjacent the collapsible portion can be used.

The principles of the present invention apply to all types of containers having various configurations and materials. For example, these principles apply equally well to containers having circular, square, or rectangular, cross-sectional configurations. They also apply to a variety of container materials, such as aluminum, plastic, glass, or cardboard paper.

Furthermore, the accordion-like construction of the collapsible portion of the container of the present invention can be located anywhere on a particular container. For example, the collapsible portion may be found on the bottom, sides, or center of the container, thus permitting deployment of a straw, funnel, or pour spout, from other locations within the container which permit the container to be used for other purposes, besides simply drinking or pouring. Moreover, the container of the present invention has applications in a number of industrial, consumer, and recreational settings, and should not be considered limited to the specific embodiments shown in the drawings or described herein.

DRAWINGS

DESCRIPTION

Figure 1:
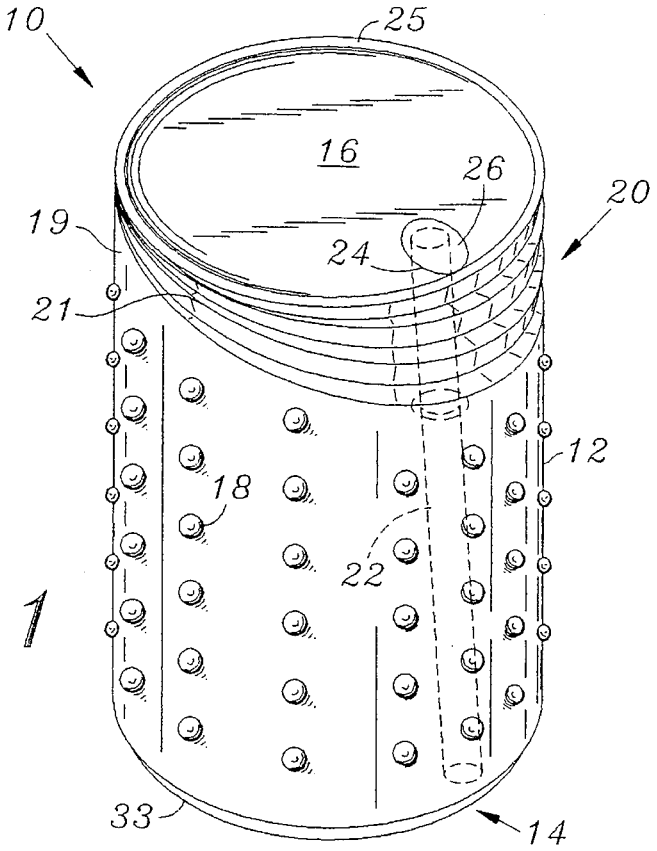
FIG. 1 is a perspective view of a container or beverage can of substantially standard size in diameter relative to height constructed in accordance with the principles of the present invention illustrating a corrugated, collapsible portion near the upper surface of the container.

Referring to FIG. 1, there is shown a container 10 constructed in accordance with the present invention, including an exterior collapsible cylindrical surface 12, a bottom surface 14 and a top surface 16. A rigid upper rim 25 connects the top surface 16 with the cylindrical side 12, and, in a similar fashion, a rigid lower rim 33 connects the cylindrical side to the bottom surface 14. Although the invention is illustrated in connection with a cylindrical container, the principles of the present invention, as pointed out above, are equally applicable to containers of all configurations and dimensions, and should not be construed as being limited to those shown in the drawings. Also shown on the exterior of the cylindrical side surface of the container are raised protrusions 18 which provide several advantages, as described more fully below.

Shown in FIG. 1 is a collapsible portion 20 of the container 10 located near the top surface 16. This collapsible portion 20 can be manually manipulated by the consumer to reveal a drinking straw 22, shown in dashed lines in FIG. 1. The collapsibility of this portion 20 of the container 10 is provided by the nature of its construction in which it is structurally less rigid on the vertical axis than the other portions around the circumference of the container side 12. This decreased rigidity can be provided in a number of ways, for example, by providing a plurality of corrugations 21 in the container side 12, in an accordion-like fashion, as shown in FIG. 1.

Figure 2:
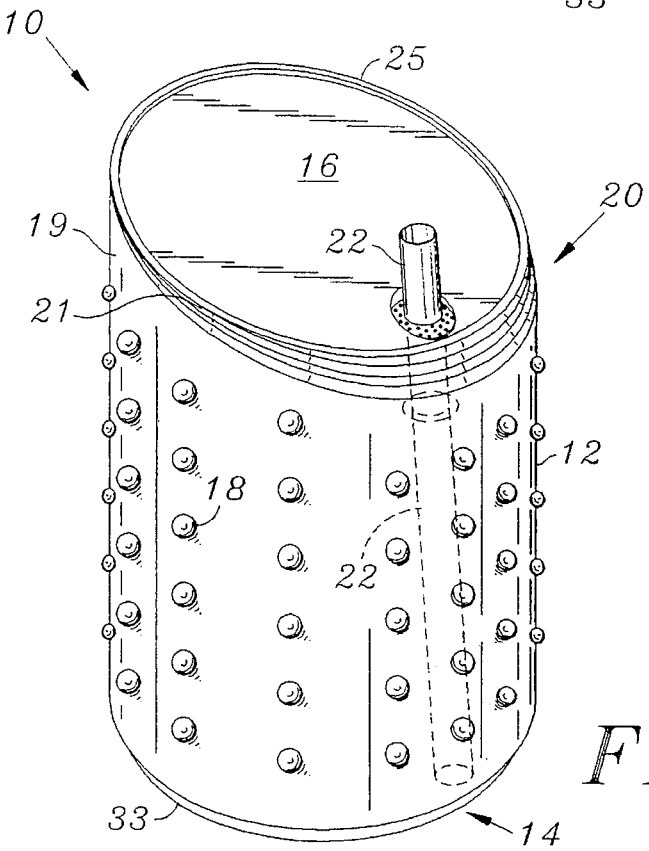
FIG. 2 is a perspective view of a container of the present invention in its collapsed state illustrating the exposure of a drinking straw for consumer use.

Preferably, the corrugated portion 20 is arranged at a downward angle along one side of the container 10 so that in its collapsed state, as shown in FIG. 2, the container top surface 16 becomes inclined. This inclined nature of the container corrugated portion 20 provides for vertical structural rigidity along a non-corrugated side 19 of the container 10, as shown in FIG. 1. Additionally, in one embodiment, the drinking straw 22 is mounted within the container 10 on the opposite corrugated side so as to act as a vertical strut or support when the container is in its non-collapsed state, as will be described further below. This permits the container 10 of the present invention to be stacked, packaged and handled like other containers as is common in the beverage industry, without resulting in premature collapse.

Shown on the top surface 16 of the container 10, as illustrated in FIG. 1, is an opening 24. In the original construction of the container 10, the opening 24 is closed or sealed by a portion of material comprising a cover 26 having the same configuration as the opening 24. This cover 26 is attached to the opening 24 on the container 10 by any means sufficient to cause a weakened state around the periphery of the cover which can be readily penetrated. For example, the opening 24 can preferably be formed simply by perforating the container top 16 in the configuration of the opening so that the perforations weaken the attachment of the cover 26 to the container.

Figure 3:
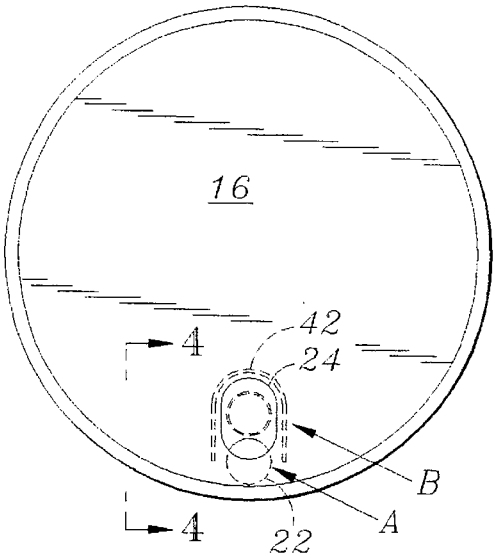
FIG. 3 is a top view of the container of the present invention illustrating the different positions of the drinking straw.
Figure 4:
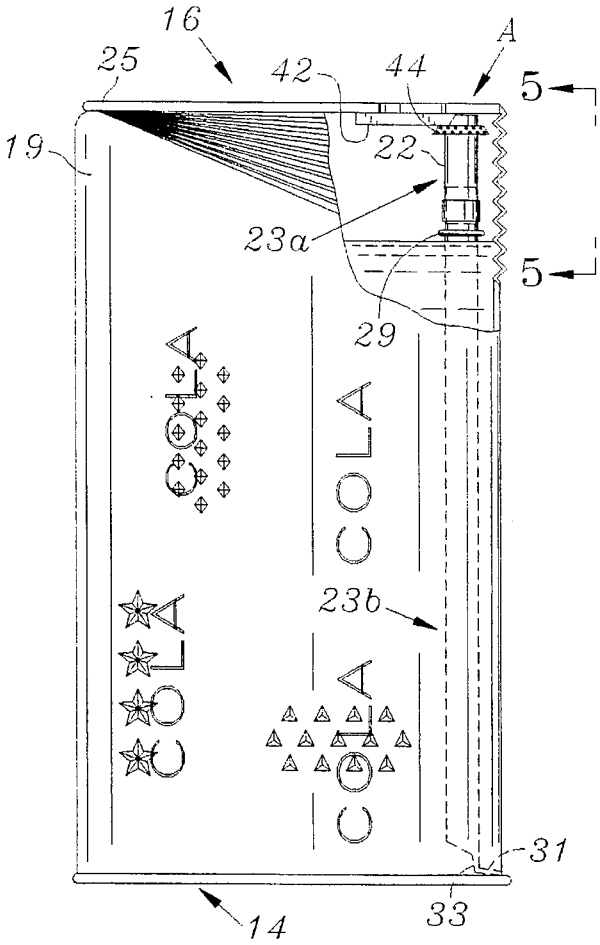
FIG. 4 is a partial cut-away side view of the container of FIG. 3 taken from line 4—4, illustrating the container before collapsing with the straw in its shipping position. Also illustrated are several possible shapes of protrusions integral with the exterior of the container.
Figure 6:
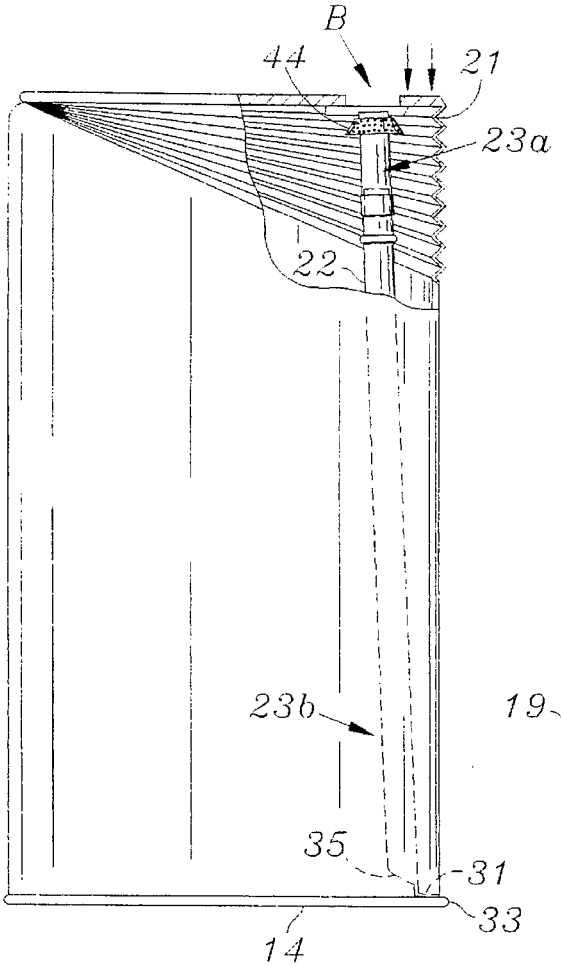
FIG. 6 is a partial cut-away side view of the container of FIG. 3 taken from line 4—4, illustrating the container just prior to collapsing with the straw moved into a position under the opening at the top of the container.
Figure 11:
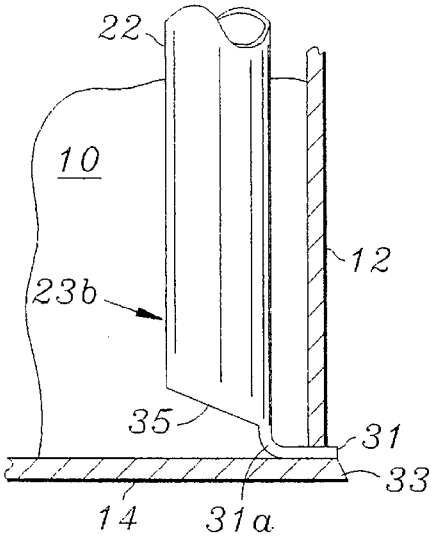
FIG. 11 is a partial view of the bottom end of the drinking straw illustrating the fixing and support tab connected to the bottom end of the container.
Figure 12:
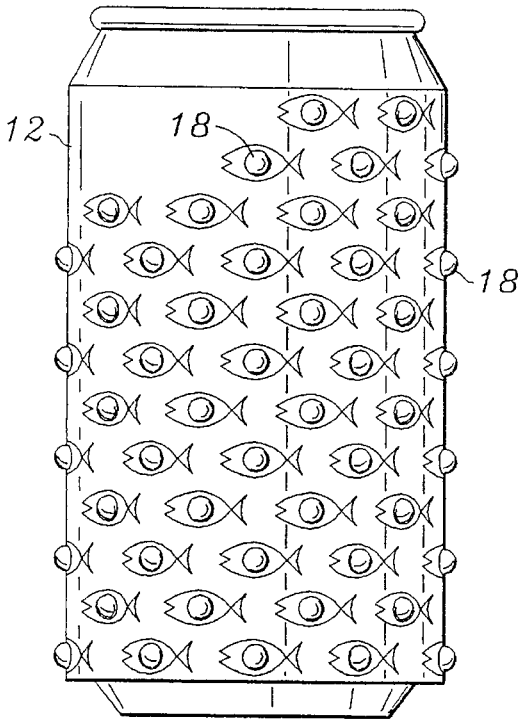
FIG. 12 is front view showing a standard can with an repetitive fish art work ornamental design on the surface.
Figure 13:
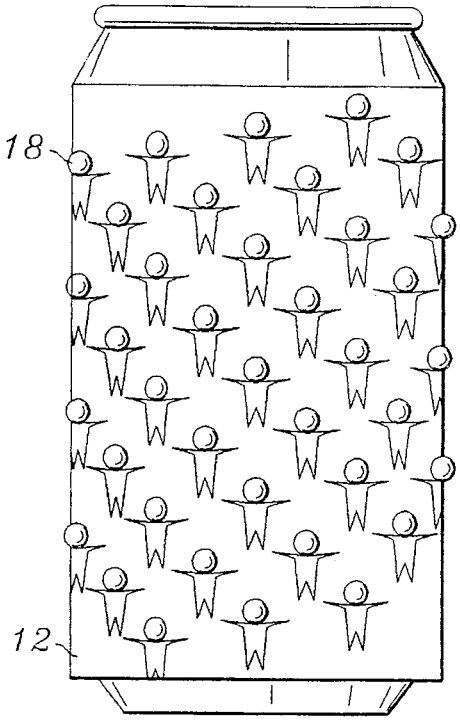
FIG. 13 is front view showing a standard can with an repetitive human figure art work ornamental design embossed on the surface.
Figure 14:
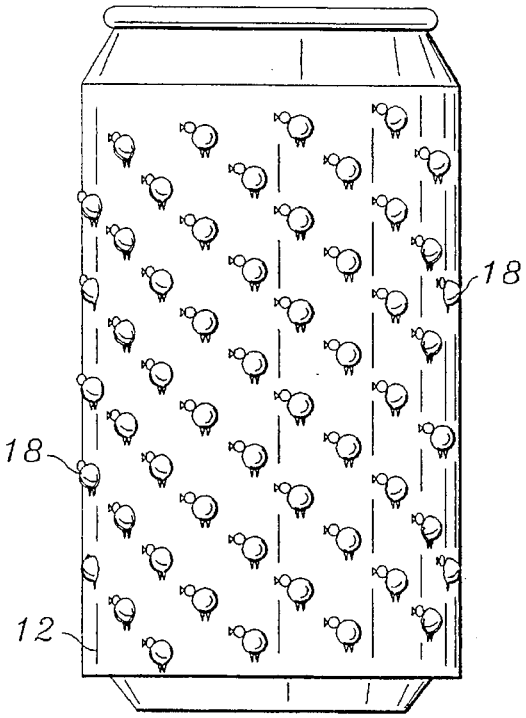
FIG. 14 is front view showing a standard can with an repetitive sheep art work ornamental design embossed on the surface.
Figure 15:
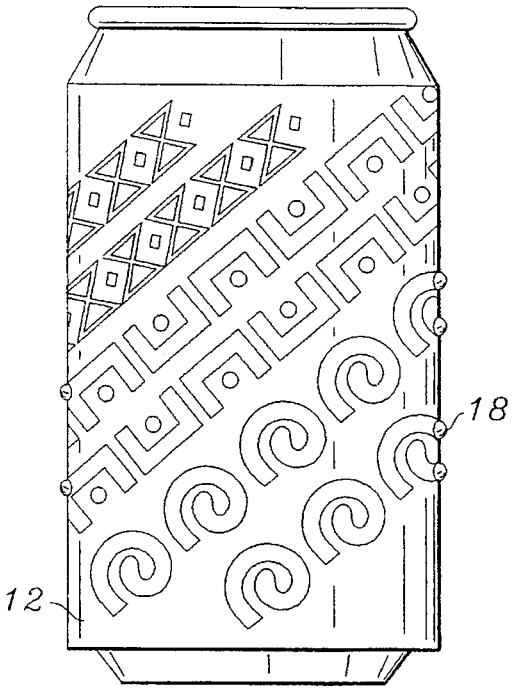
FIG. 15 is front view showing a standard can with an printed layer repetitive art work ornamental logo and pattern design embossed on the surface.

Referring to FIG. 3, an upper portion **23*a* of the drinking straw 22 has two primary positions A and B. These two positions are also shown in FIGS. 4 and 6. Initially, the upper portion 23*a* of the drinking straw 22 is at A, proximate and parallel to the interior side 12 of the container 10. The edge of the opening 24 is disposed slightly radially inward of the container rim 25 such that in position A, the upper portion 23*a* of the drinking straw 22 will contact the interior of the top surface 16 directly between the opening and the upper rim. Preferably, the lower portion 23*b* of the straw 22 is pivotally mounted adjacent the interior of the bottom surface 14 by means of an extended hinge tab 31, as shown in FIGS. 4 and 11. Preferably, this attachment provides some pivoting movement at a bend 31*a* while preventing vertical movement. The straw 22 is itself constructed from a relatively rigid material so as to be capable of structurally supporting the corrugated section 20 of the container 10** when subjected to normal vertical loads such as those experienced during shipping and distribution.

As shown in FIG. 3, the straw 22 can be moved to the second position B by pressing radially inward on the container side surface 12 nearest the straw. The upper portion **23*a* of the drinking straw 22 is laterally moved away from the side as it pivots about its lower end 23*b*, and into a position directly below the opening 24 (also seen in FIG. 6). A raised U-shaped ridge 42 adjacent the opening 24 on the inside surface of the container top 16 prevents the straw 22 from being pushed past the opening. In this regard, the straw 22 may be moved into position beneath the opening 24 between the legs of the U-shaped ridge 42 and thus be constrained from further movement by the closed end of the ridge. At the same time, the straw 22 is allowed to hinge at its lower portion 23*b* and rotate slightly. Once the drinking straw 22 is in position, it is rigid enough to be capable of penetrating the weakened opening 24 on the container top 16. The rigidity of the drinking straw 22 allows the container 10 to be shipped without risk of the container prematurely collapsing, yet its pivoting connection provides for movement of the straw to facilitate puncture of the opening 24 and collapse of the corrugated section 20**.

Figure 7:
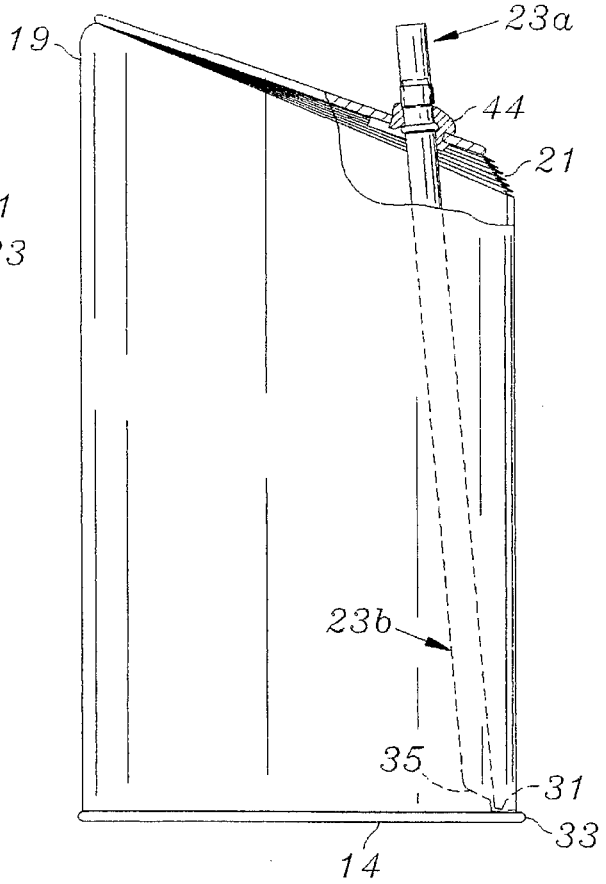
FIG. 7 is a partial cut-away side view of the container of FIG. 3 taken from line 4—4, illustrating the container after collapsing with the straw extending through the opening in the top of the container.

In use, once the straw 22 is moved to position B, the consumer manually manipulates the container 10 near the corrugated portion 20 by grasping the cylindrical container side 12 with two hands and placing both thumbs on the container top 16 above the corrugated portion 20, but away from the opening 24. The thumbs could then be used to exert the manual pressure necessary to collapse the container 10. The opening 24 should not be blocked by the hands of the consumer so that the straw 22 can freely penetrate therethrough and become exposed above the container top 16. A little extra manual force is required to overcome the initial rigidity provided by the corrugations 21. Thereafter, the corrugations 21 permit the container 10 to be readily collapsed in a downwardly inclined fashion, as illustrated in FIGS. 2 and 7.

As the container top 16, above the corrugated portion 20, moves downwardly, the upper portion **23*a* of the straw 22** comes into contact with the weakened cover 26 of the opening 24, thus causing the cover to fail. The straw 22 engages and displaces the cover 26 and then penetrates the opening 24 and becomes exposed. FIGS. 2 and 7 illustrate the container 10 of the present invention in its collapsed state in which the upper portion of the straw 22 is exposed beyond the container top surface 16. Yet another aspect of this invention would involve the use of horizontal corrugations (not shown) formed circumferentially around the entire container 10, so that in its collapsed state, the top 16 of the can remains horizontal or flat.

It should be pointed out that the inclined nature of the corrugations 21 causes the collapsible portion 20 to follow a slight arc along the radius defined by the diameter of the container. This means that as the top surface 16 is collapsed, the container top 16 will hinge about the non-corrugated top side 19 of the container, in which case the opening 24 will shift gradually radially inward as the top is depressed. Because of the hinge tab bend 31*a*, the straw 22 continues to rotate about its lower portion 23*b* inward, as can be seen in FIGS. 6 and 7.

A sponge-like ring member 44 is positioned at the very tip of the upper portion 23*a* of the straw 22, such that when the straw penetrates the opening 24 at the top of the container 10, the sponge-like ring member fits snugly within the opening to provide a seal. The sponge-like ring member 44 prevents liquid from being spilled out between the straw 22 and the opening 24 as the corrugated portion 20 is pressed downward, and slides easily down the straw so that it remains within the opening.

Figure 5:
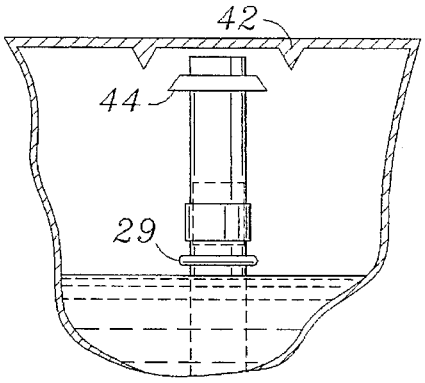
FIG. 5 is a partial cut-away view of the front of the container showing the straw of FIG. 4 taken from line 5—5.

In order to prevent the collapsed portion 20 of the container 10 from springing back upwardly toward its original position, the straw 22 is provided with a stopping mechanism illustrated in FIGS. 4 and 5. The stopping mechanism is comprised of a collar 29 mounted around the straw 22 near its upper portion 23*a* but under the sponge-like ring member 44. After the straw 22 has penetrated the opening 24 and the corrugated portion 20 is compressed to expose the upper portion 23*a* of the straw, the sponge-like ring member 44 slides down and engages the collar 29. The collar 29 then engages the sponge-like ring member 44 with the edges of the opening 24 in a friction-fit or press-fit relationship. This engagement causes the container top 16 to be held in its collapsed position, as shown in FIGS. 2 and 7, with the sponge-like ring member 44 wedged between the collar 29 and opening 24, as seen in FIG. 7. The collar 29 can be constructed from any suitable elastic material which can frictionally engage the edges of the opening 24.

As seen best in FIG. 11, the drinking straw 22 is mounted to the bottom 14 of the container 10 by the bottom tab 31 which is rigidly attached proximate and between container the lower rim 33 and side 12. Various fixing means may be used that are well known in the art. The lower portion 23*b* of the straw 22 terminates in an angled opening 35. The opening 35 is angled upward and away from the container side 12 to facilitate passage of liquids therethrough. The tab 31 is integral with the straw 22 and extends vertically downward from the lowermost portion 23*b* of the straw on the side closest to the cylindrical container side 12. The tab 31 is relatively narrow to enable it to extend vertically from the straw 22 and include the transition bend 31*a* to a horizontal mounting orientation.

In the initial configuration, shown in FIG. 4, the straw 22 is vertically disposed and extends the full length of the container 10 height from the bottom 14 to the top surface 16. The tab 31 is sufficiently strong to support nominal compressive stresses transmitted through the straw 22 from the container top surface 16. FIG. 6 shows the straw 22 in a tilted posture prior to collapsing the corrugated portion 20 of the container with the straw pivoting about the bend 31*a* in the tab 31. As the corrugated portion 20 is depressed to force the upper portion 23*a* of the straw 22 through the opening 24, the straw 22 will be tilted further due to the arcuate path followed by the opening 24, as seen in FIG. 7. The flexible bend 31*a* in the tab 31 allows this further tilt.

Figure 8:
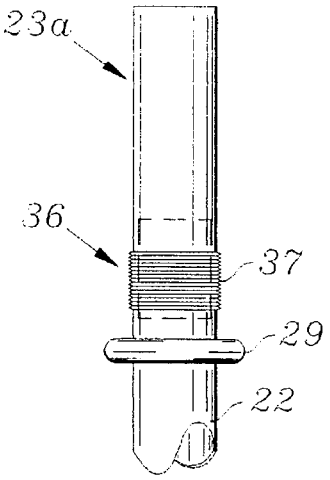
FIG. 8 is a partial view of the top end of the drinking straw in its compressed state further illustrating a stopping mechanism mounted near the upper portion thereof.
Figure 10:
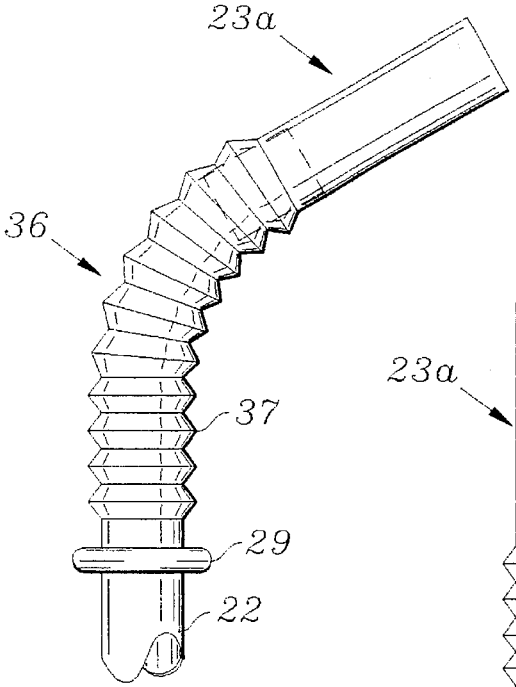
FIG. 10 is a partial view of the top end of the drinking straw in its extended and bent state.
Figure 9:
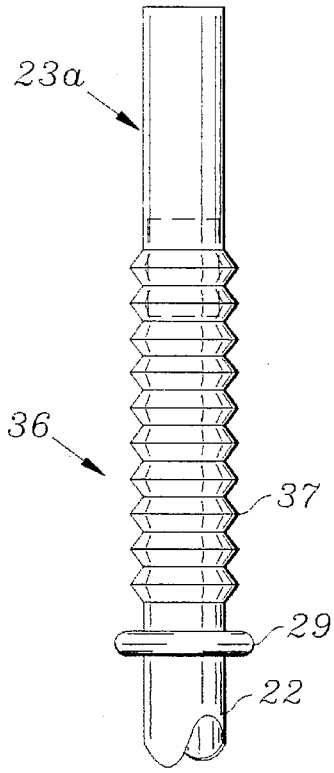
FIG. 9 is a partial view of the top end of the drinking straw in its extended state.

FIGS. 8–10 illustrate a flexible portion 36 of the drinking straw 22. Horizontal accordion-like creases 37 are disposed around the straw 22 slightly above the stopping collar 29. Initially, as seen in FIG. 8, the creases 37 are compressed to allow the straw 22 to fit inside the container 10. Upon puncture of the opening 24, the upper portion 23*a* of the straw 22 may be pulled to extend the straw by unfolding of the creases 37 (FIG. 9). A further convenience to the consumer is provided by the creases 37 which allow bending of the straw 22 toward the horizontal, as seen in FIG. 10.

The aforementioned protrusions 18 formed integrally on the exterior of the cylindrical side 12 of the container 10 may be hemispherically shaped, as shown in FIGS. 1 and 2, but can also be formed into any other shapes or configurations, including, but not limited to, stripes, diamonds, triangles, stars, animal shapes, etc., as partially shown in FIG. 4. Indeed, the protrusions can take the shape of a logo, trademark or trade name, thereby enhancing its identifiability with the consuming public.

A preferred arrangement of the protrusions 18 would concentrate a number of them in the regions of the container side 12 whereby a consumer would grasp the container and contact a plurality of protrusions, which are raised with respect to the side surface. The plurality of protrusions will enhance the ability of the user to grasp the container, the protrusions providing a gripping means to reduce the possibility providing a gripping means to reduce the possibility of slippage. Because the immersion of beverage containers in ice water or when condensation occurs in the ambient air leave smooth-sided containers wet and prone to droppage, the present invention advantageously improves the grip on the container without adding additional weight and without affixing friction-like members to the container. The raised protrusions 18 of the present invention substantially increases the traction afforded by the exterior of the sides 12 of the container 10 and leads to a reduction of the instances of dropping or spilling.

In addition, because the protrusions 18 are integrally formed on the exterior side surface 12 of the container 10 and project outward, the protrusions advantageously increase the volume within the container. Thus, an increased volume of fluids can be stored in the container 10, making each container more efficient. The volume of the container can be increased up to a full 10% or more, i.e., a 12-ounce container can be increased a full ounce or more.

The increase in volume of each container also permits the container to be manufactured slightly shorter than other conventional standard volume beverage containers. Typically, beverage containers are constructed to be collapsible and are made from aluminum. The standard container has a smooth cylindrical surface, shaped to allow a user to grasp the container easily. The container, therefore, must be of sufficiently narrow size, although the container can be made taller to provide the sufficient volume needed. Because the protrusions 18 of the present invention provide additional volume to the container, the container can be manufactured slightly shorter without increasing the width of the container, although the improved gripping of the container will allow the container to be made slightly wider than convention containers. By making each container shorter, the containers can be stacked and stored more efficiently. The shorter size of the containers can also be displayed in areas where vertical space is limited. The protrusions can also be configured such that when the containers are stored side by side, the protrusions of each adjacent container can interlock, or at least be positioned so that the containers do not take up additional space.

In the manufacturing process, the container is made of a thin sheet of metal or metal-like material, such as aluminum, which is pressed and rolled to the proper thickness. The protrusions 18 of the present invention can easily be formed on the sheets by a stamping process which pushes the protrusions 18 outward on one side and creates indentations on the other side. The protruding side will be positioned on the outer surface, to provide the improved gripping means, and the indentation side shall be provided on the inside of the container, to increase the fluid volume therein. Unlike the prior containers, made of styrofoam or glass, which must be formed by a vacuum injection process, permitting only protrusions on one side without indentations on the other side, the present invention contemplates use of materials which can physically be stamped to provide the combination of an indentation on one side and a protrusion on the other side. This manner of manufacturing can also achieve cost savings, as the volume of the container can be increased without increasing the amount of material used or the size of the container.

In addition, because the protrusions 18 project outward, the hand of the consumer will predominantly come into contact with the protrusions, without substantially touching the cylindrical side 12 of the container, which reduces the amount of surface area contact between the user's hand and the container side. By reducing the contact surface area between the user's hand and container 10, and isolating the contact to the protrusions 18 only, a decrease in conductive heat transfer from the hand of the consumer to the container, and vice versa, can be achieved. The beverage in the container 10 of the present invention thus remains colder longer, while the consumer experiences less discomfort when handling extremely cold containers.

A further advantage of the protrusions 18 is that they can be shaped and arranged to convey any message to consumers. The exterior side surface 12 of the container 10 can be designed with various shapes which can be incorporated into the trademark or trade dress of the product. Each protrusion 18 can be colored with patterns or designs or made into a texture to make the container 10 aesthetically distinct and recognizable. One incidental benefit of having the protrusions 18 is that they may also convey particular messages to the blind. Various messages can be placed on containers which can be identified by the blind, such as, for instance, containers containing toxic substances, etc.

The protrusions 18 on the side of the container also provide additional strength to the container. The protrusions 18 can be configured into shapes, including ribs, to provide structural rigidity to the container, which permits the containers to be stacked more readily.

In the embodiments of FIGS. 12 to 16 there are shown configurations of the can with different embossing on the surface. In FIGS. 12 to 15 the embossing of a recognizable form is effected on a thin gauge collapsible aluminum can of relatively standard dimensions in height relative to diameter for a conventional beverage can, for instance, for dispensing cool drinks such as a soda. Such a can is crushable under the action of finger pressure when there is no fluid present in the interior of the can.

The size of such a standard volume can for 12 fluid ounces would be a height of about 5 inches and a diameter of about 2.5 inches, namely a ratio of about 2:1 between the height and the diameter. In these embodiments, the embossed effect allows the contents of the same overall size can to be increased in volume so that, for instance, an extra 0.5 to 1 fluid ounce of liquid can be contained in the can. This would depend on the number of protrusions and the overall depth of the protrusions from the basic surface of the can.

Figure 16:
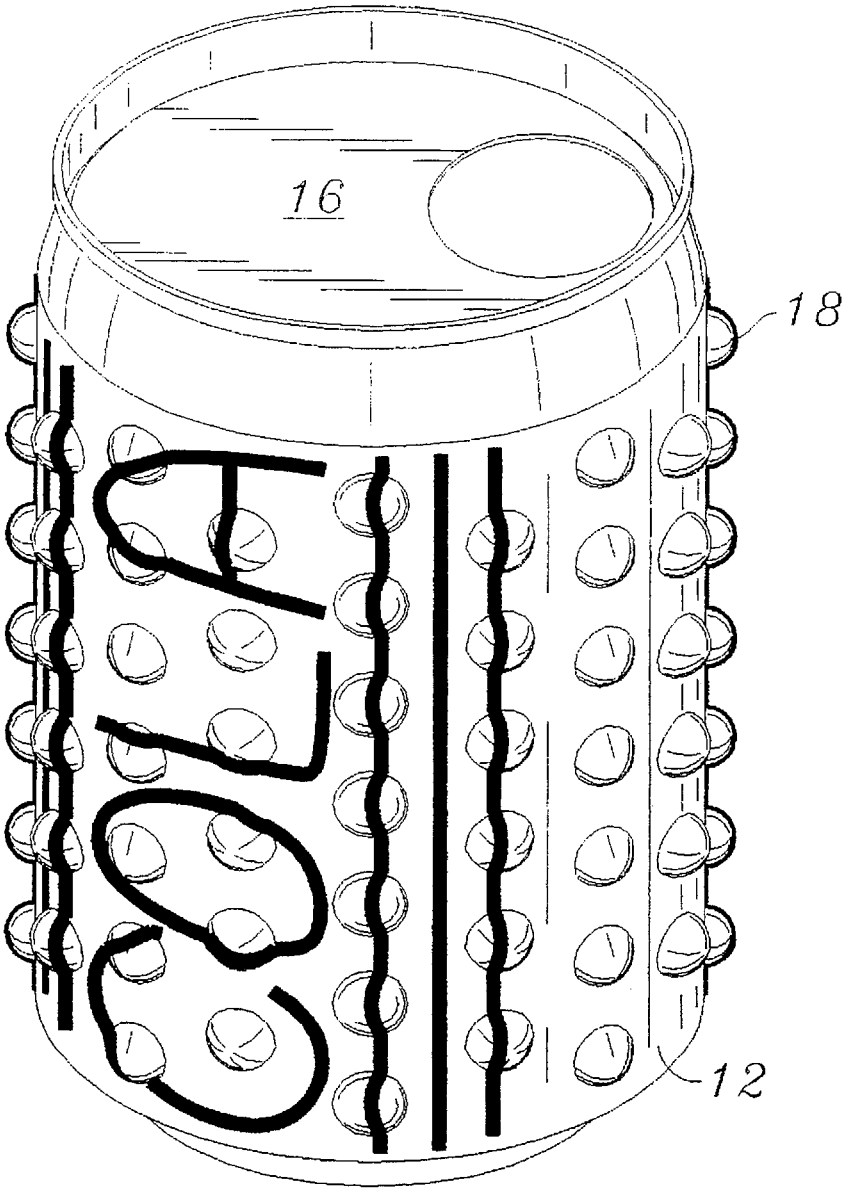
FIG. 16 is front view showing a can with a logo printed and embossed on the surface of a can which is relatively shorter in height and with a larger diameter than a standard size can.

In the embodiment illustrated in FIG. 16, the can illustrated is relatively squatter, namely the can is made shorter in height and larger in diameter. As such the can may have a height of about 4.5 inches and diameter of about 2.5 inches to contain the same 12 ounces of liquid. In such a manner, the ratio of the height to the diameter can change top be less than about 2:1. Alternatively the dimensions can change to form a can of a different structure wherein the ratio of the height to the diameter changes to less than 2:1 to about 1:1.

By having a can of the greater diameter and less height, and with the protrusions, there is less of the contents of the can which is exposed to contact with the hand of a user, particularly where the hand of the user contacts essentially only the protrusions about the surface. Less of the fluid content of the can is in potential contact with the surface of the inner surface of the can. Thus, less heat transmission through the material is effected by the contact with the outside opposite surface through the hand. There is, thus, less possibility for conduction of heat from the hand to penetrate through the surface into the fluid, and cause an undesirable warming of the fluid. There is less likelihood of temperature conduction between the hand and the contents of the can.

In the can of FIG. 16, there is shown a printed layer on the surface of the can of the lettering of a trademark. These letters and representations rise and fall relative to the overall flat surface of the can. In this manner, the printed lettering forms a generally three-dimensional effect which substantially enhances the can. A similar effect is achieved with the repeating art work designs and logo that are printed and embossed onto the can surface in the embodiments having the protrusions. Such artwork can also have a printed layer on the surface of different coloring over the protrusions to enhance the can.

In another embodiment of the present invention, the drinking straw can be replaced by a funnel or pour spout (not shown). Such a funnel or spout can be utilized to dispense a wide variety of fluids, as well as other materials, for consumer or industrial use. As the container is collapsed in the same fashion described above, the top of the funnel or spout comes into contact with the weakened opening (not shown) of the container top, thus causing the funnel or spout to be exposed. The funnel or spout is also provided with a collar or stopping mechanism for holding the container top in its collapsed state.

It should also be pointed out in connection with this invention that the relative strength and rigidity of the container 10, its corrugated portion 20, and the opening 24 can be adjusted to accommodate different container materials and fluids. For example, in certain applications, it may be preferable for the top portion **23*a* of the straw 22 or spout to form its own opening 24 by perforating the top surface 16 of the container 10 which surface is completely comprised of a weakened material such as paper or cellophane. Thus, it may not be necessary to have a discrete perforated opening 24**, as described above.

In conclusion, the present invention provides a simple, yet reliable, method for deploying a drinking straw, funnel, pour spout or similar utensil from the interior of a fluid container. Furthermore, the container is easy to manufacture and simple to use.

What is claimed is:

1. A container for a fluid, comprising:

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a pattern of protrusions of a preselected shape, height, configuration and arrangement, the protrusions enhancing the exterior periphery of the body portion by providing traction thereto whereby the container can be more securely held when the container becomes wet or cold, the protrusions extending outwardly to increase the volume of container relative to the same container without embossing and to substantially decrease the area of contact with the hand of a user holding the container such that there is less temperature conduction between the hand and the fluid in the container and, the body including an outside surface, and including a printed layer of an ornamental representation on the outside surface, the ornamental representation acting to enhance the ornamental effect of the surface, and the ornamental representation including in at least some part printed lettering, and at least some part of the ornamental representation extending over the protrusions.

2. A container as claimed in claim 1 for a drinkable liquid, the container being of a relatively increased volume in relation to a standard volume container and including an aluminum thin gauge material, the container being crushable under finger pressure when there is no liquid in the container.

3. A beverage container comprising:

an elongated generally cylindrical body portion forming a side wall and having first and second ends, the cylinder being formed of a thin material collapsible when empty of fluid;

a bottom portion sealing the first end;

a substantially planar top portion sealing the second end and having an aperture;

a cover member releasably secured to the top portion for sealing the aperture to provide a closed cavity suitable for containing a drinkable beverage fluid;

the body portion having disposed thereon and embossed therein a pattern of protrusions of a preselected shape, height, configuration and arrangement, the respective protrusions being generally separately located from each other and integrally connected with each other solely by the side wall, and not by other protrusions, the protrusions enhancing the exterior periphery of the body portion by providing traction thereto whereby the container can be more securely held when the container becomes wet or cold, the protrusions extending outwardly to increase the volume of container and to substantially decrease the area of contact with the hand of a user holding the container such that there is less temperature conduction between the hand and the fluid in the container, and the body including an outside surface, and including a printed layer of an ornamental representation on the outside surface, the ornamental representation extending at least in part over the protrusions thereby to enhance the ornamental effect of the surface, and wherein the ornamentation includes lettering.

4. A container for a fluid, comprising:

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a pattern of protrusions of a preselected shape, height, configuration and arrangement, the protrusions enhancing the exterior periphery of the body portion by providing traction thereto whereby the container can be more securely held when the container becomes wet or cold, the protrusions extending outwardly to increase the volume of container relative to the same container without embossing and to substantially decrease the area of contact with the hand of a user holding the container such that there is less temperature conduction between the hand and the fluid in the container, wherein the protrusions are a shape selected to be at least one of repetitive triangle, star, rectangle, circle or recognizable form, and wherein the body includes an outside surface, and including a printed layer of an ornamental representation on the outside surface, the ornamental representation extending at least in part over the protrusions thereby to enhance the ornamental effect of the surface, and wherein the ornamentation selectively includes printed lettering.

5. A beverage container comprising:

an elongated generally cylindrical body portion forming a side wall and having first and second ends, the cylinder being formed of a thin material collapsible when empty of fluids;

a bottom portion sealing the first end;

a substantially planar top portion sealing the second end and having an aperture;

a cover member releasably secured to the top portion for sealing the aperture to provide a closed cavity suitable for containing a drinkable beverage fluid; and the body portion having disposed thereon and embossed therein a pattern of protrusions of a preselected shape, height, configuration and arrangement, the respective protrusions being generally separately located from each other and integrally connected with each other solely by the side wall, and not by other protrusions, the protrusions enhancing the exterior periphery of the body portion by providing traction thereto whereby the container can be more securely held when the container becomes wet or cold, the protrusions extending outwardly to increase the volume of container and to substantially decrease the area of contact with the hand of a user holding the container such that there is less temperature conduction between the hand and the fluid in the container, wherein the protrusions are a shape selected to be at least one of repetitive triangle, star, rectangle, circle or recognizable form, and wherein the body includes an outside surface, and including a printed layer of an ornamental representation on the outside surface, the ornamental representation extending at least in part over the protrusions thereby to enhance the ornamental effect of the surface, and wherein the ornamentation selectively includes printed lettering.

6. A container for a fluid, comprising:

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a pattern of protrusions of a preselected shape, height, configuration and arrangement, the protrusions enhancing the exterior periphery of the body portion by providing traction thereto whereby the container can be more securely held when the container becomes wet or cold, the protrusions extending outwardly to increase the volume of container relative to the same container without embossing and to substantially decrease the area of contact with the hand of a user holding the container such that there is less temperature conduction between the hand and the fluid in the container;

a collapsible portion of the container adapted to collapse upon manual manipulation thereof, the collapsible portion being in the side wall, the side wall being connected to the top surface and the base; and a dispensing member located within the container for dispensing the contents of the container, wherein the dispensing member is pivotally mounted at the bottom of the container and extends vertically upward such that the top end of the dispensing member abuts the inside portion of the top surface, wherein upon the manual manipulation of the side wall of the container, the upper portion of the dispensing member being laterally shifted to a location beneath the aperture whereby on removal of the cover member the dispensing member extends through the aperture.

7. The container of claim 6, wherein the dispensing member is selectively at least one of a straw, a pour spout, or a funnel.

8. The container of claim 7 wherein the collapsible portion collapses substantially to one side of the container upon use.

9. The container of claim 8, wherein the collapsible portion consists of an integrated and corrugated surface, the collapsible portion being selectively located on the upper portion of the container.

10. A container for a fluid, comprising:

an elongated generally cylindrical body portion having first and second ends;

a bottom portion sealing the first end;

a substantially planar top portion sealing the second end and having an aperture;

a cover member releasably secured to the top portion for sealing the aperture, wherein the cover member provides a closed cavity suitable for containing a fluid without fluid communication therethrough;

the body portion having disposed thereon and embossed therein a pattern of protrusions of a preselected shape, height, configuration and arrangement, the protrusions enhancing the exterior periphery of the body portion by providing traction thereto whereby the container can be more securely held when the container becomes wet or cold, the protrusions extending outwardly to increase the volume of container relative to the same container without embossing and to substantially decrease the area of contact with the hand of a user holding the container such that there is less temperature conduction between the hand and the fluid in the container, and including a hollow dispensing member pivotally mounted within the cavity adjacent or on the bottom portion of the container, the dispensing member extending substantially the length of the cavity and being detachably mounted adjacent or on the top portion of the container.

* * * * *

UNITED STATES PATENT AND TRADEMARK OFFICE

CERTIFICATE OF CORRECTION

PATENT NO. : 5,586,681

DATED : December 24, 1996

INVENTOR(S) : Nini E. Policappelli

It is certified that error appears in the above-indentified patent and that said Letters Patent is hereby corrected as shown below:

Column 1, line 63, "pup-up" should read --pop-up--

Column 1, line 66, insert --of-- after the word "use"

Column 4, line 4, insert --.-- after the word "opening"

Column 4, line 4, "upon" should read --Upon--

Column 8, line 36, delete "providing a gripping means to reduce the possibility" after the word "possibility"

Column 10, line 18, "top be less" should read --the top to be less--

Column 12, line 48, "fluids" should read --fluid--

Signed and Sealed this

Twenty-eighth Day of October, 1997

*Attest:*

*Attesting Officer*

Bruce Lehman

BRUCE LEHMAN

*Commissioner of Patents and Trademarks*